United States Patent [19]

Olesin et al.

[11] 4,374,357

[45] Feb. 15, 1983

[54] SWITCHED CAPACITOR PRECISION CURRENT SOURCE

[75] Inventors: Andrew Olesin; Kevin K. L. Luke, both of Austin; Robert D. Lee, Denton, all of Tex.

[73] Assignee: Motorola, Inc., Schaumburg, Ill.

[21] Appl. No.: 286,446

[22] Filed: Jul. 27, 1981

[51] Int. Cl.[3] ..... G05F 1/46

[52] U.S. Cl. ..... 323/351; 323/284; 307/297; 307/304; 320/1

[58] Field of Search ..... 320/1; 307/296 R, 297, 307/304, 109; 323/284, 285, 288, 312-317, 350, 351

[56] References Cited

U.S. PATENT DOCUMENTS

| | | | |
|---|---|---|---|
| 3,675,115 | 7/1972 | O'Loughlin | 323/351 |
| 3,777,253 | 12/1973 | Callan | 323/284 |
| 3,805,146 | 4/1974 | Culley | 320/1 |
| 3,839,673 | 10/1974 | Acker | 320/1 X |
| 4,051,428 | 9/1977 | Imai | 323/317 |
| 4,199,693 | 4/1980 | Bennett | 307/304 X |
| 4,344,121 | 8/1982 | Weber | 323/284 X |

*Primary Examiner*—William M. Shoop
*Assistant Examiner*—Peter S. Wong
*Attorney, Agent, or Firm*—Anthony J. Sarli, Jr.; Jeffrey Van Myers; James L. Clingan, Jr.

[57] ABSTRACT

A switched capacitor precision current source uses a capacitance to store a predetermined charge in response to a clock to provide an average current proportional to the frequency of the clock and the predetermined charge. The average current is useful for generating bias voltages for N channel and P channel current sources.

11 Claims, 1 Drawing Figure

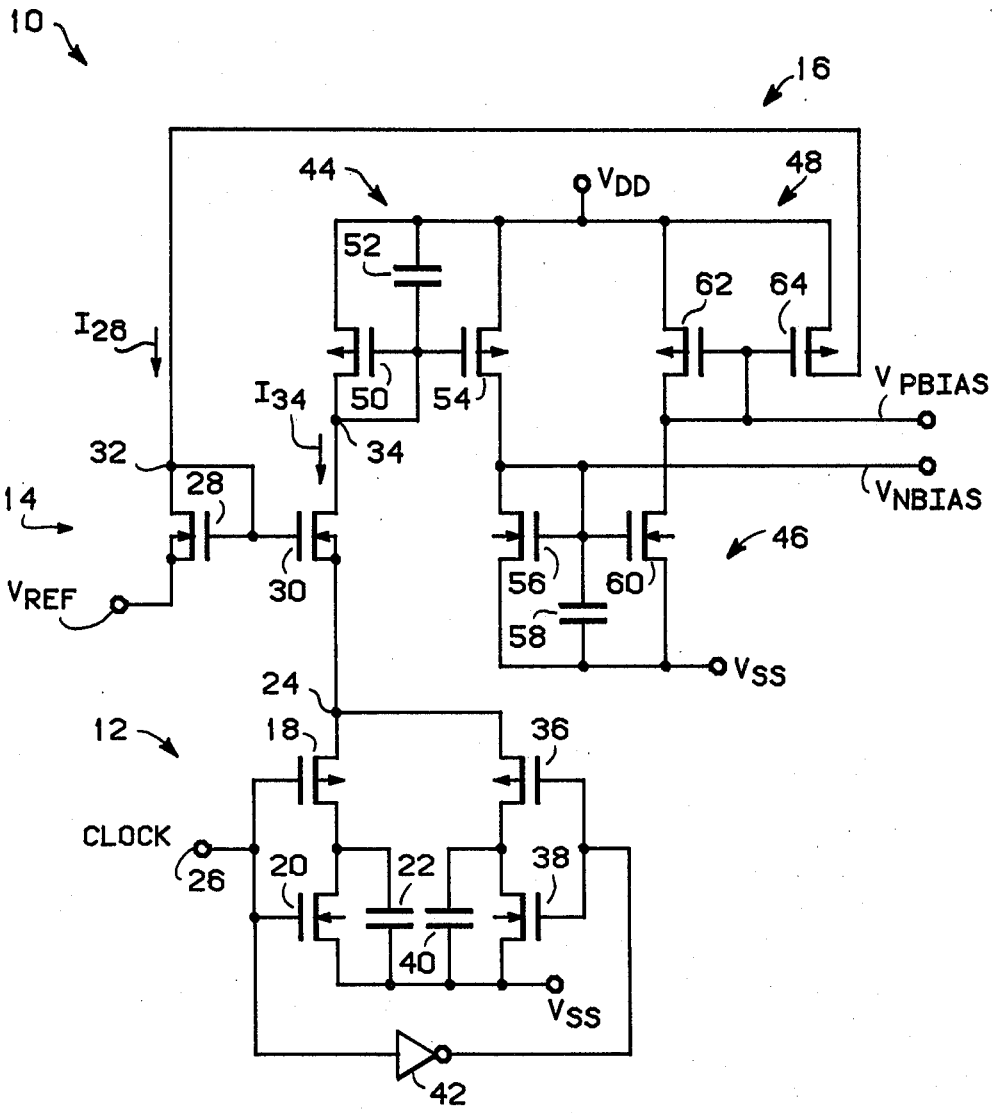
10
16
44
48
$V_{DD}$
52
62
64
$I_{28}$
$I_{34}$
50
54
$V_{PBIAS}$
32
34
28
14
$V_{NBIAS}$
46
$V_{REF}$
30
56
60
58
$V_{SS}$
24
12
18
36
CLOCK
26
20
22
38
40
$V_{SS}$
42

SWITCHED CAPACITOR PRECISION CURRENT SOURCE

TECHNICAL FIELD

This invention relates generally to current sources and, more particularly, to switched capacitor precision current sources useful in generating reference voltages for bias current generators.

BACKGROUND ART

Precision current sources are normally generated with a reference voltage applied across a precision resistor which provides a current to a tolerance proportional to the tolerance of the voltage and the resistance. In some integrated circuit technologies, for example CMOS technology, resistors can be fabricated but with insufficient control to obtain precise predictable resistance values. Additionally, such resistors vary significantly with environmental changes such as temperature. In comparision, capacitors can be fabricated with substantially more precision than resistors. Using capacitors, however, is not convenient for generating current sources, particularly d.c. current sources.

BRIEF SUMMARY OF THE INVENTION

An object of the invention is to provide a switched capacitor precision current source which does not require resistors.

Another object of the invention is to use capacitance values in determining magnitude of a precision current source.

A further object of the invention is to provide an improved precision current source suitable for generating a precision reference voltage.

Yet a further object is to provide an improved precision current source which is self-biasing and self-starting.

These and other objects of the invention are achieved in accordance with a preferred embodiment of the invention by providing a current source for providing current at a charge node until a predetermined voltage is reached. The predetermined voltage is proportional to a reference voltage. The charge node is coupled to a capacitor via a charging transistor which is controlled by a clock signal. During a charge period of the clock signal, the charging transistor provides a current path from the charge node to the capacitor. Current flows into the capacitor until the predetermined voltage is reached. During a discharge period of the clock signal, a discharge transistor provides a current path for discharging the capacitor. A precision current is generated at an output of the current source proportional to the predetermined voltage, the frequency of the clock signal, and the capacitance of the capacitor.

In a preferred form, a second capacitor is used in cooperation with a second charging transistor so that the second capacitor is charged to the predetermined voltage while the first capacitor is being discharged. A second discharging transistor discharges the second capacitor while the first capacitor is being charged. The use of the second capacitor reduces ripple of the precision current.

BRIEF DESCRIPTION OF THE DRAWING

The single FIGURE illustrates in schematic form a switched capacitor precision current source constructed in accordance with a preferred embodiment of the invention.

DESCRIPTION OF A PREFERRED EMBODIMENT

Shown in the drawing is a switched capacitor precision current source circuit 10 constructed in accordance with the preferred embodiment of the invention. The precision current source circuit 10 is comprised generally of a charge and discharge circuit 12, a current control circuit 14, and a voltage bias generator and filter circuit 16. Transistors used in the preferred embodiment are insulated gate field effect transistors.

The charge and discharge circuit 12 comprises at least a P channel transistor 18, an N channel transistor 20, and a capacitor 22. The transistor 18 has a source connected to a charge node 24, a gate connected to a clock input terminal 26, and a drain connected to a first end of capacitor 22. The transistor 20 has a source connected to a first supply voltage terminal $V_{SS}$, a gate connected to clock input terminal 26, and a drain connected to the first end of capacitor 22. A second end of capacitor 22 is connected to $V_{SS}$.

Current control circuit 14 comprises N channel transistors 28 and 30. Transistor 28 has a source connected to a reference voltage $V_{REF}$, and a drain and a gate connected to a first current node 32. The transistor 30 has a gate connected to the gate of transistor 28, a source connected to the charge node 24, and a drain connected to a second current node 34. Current node 34 is an output node of the precision current source circuit 10. In the illustrated embodiment, current at current node 34 is filtered and used for generating bias voltages by the voltage bias generator and filter circuit 16.

In the preferred form, the reference voltage $V_{REF}$ is externally generated by conventional means such as a bandgap reference. One bandgap reference suitable for providing the reference Voltage $V_{REF}$ is described in the commonly assigned U.S. application Ser. No. 34,513 of Horst Leuschner. In response to the reference voltage, a bias current $I_{28}$ will flow from the first current node 32 through transistor 28 to $V_{REF}$, establishing the gate to source voltage $V_{GS}$ of transistor 28 above the source voltage $V_{REF}$ by the sum of the threshold voltage $V_{T28}$ and an incremental voltage related to the current $I_{28}$. If the bias current $I_{28}$ is selected to be sufficiently small, the incremental voltage will be negligible. Consequently, transistor 28 and 30 can be assumed to be biased at $$V_{REF}+V_{T28} \tag{1}$$

If transistor 30 and transistor 28 are constructed using conventional techniques to have substantially equal threshold voltage, i.e.

$$V_{T30}=V_{T28} \tag{2}$$

current will stop flowing from the second current node 34 to the charge node 24 when the voltage on the charge node, i.e. the source of transistor 30, rises to at least the threshold voltage $V_{T30}$ below the voltage on the gate of transistor 30. Substituting Equation 2 into Equation 1, it will be clear that the voltage on charge node 24 will be clamped to approximately $V_{REF}$.

When the clock signal, provided by any suitable external clock generator goes from a high to a low level, transistor 20 is turned off and transistor 18 is turned on, allowing transistor 30 to source current to charge capacitor 22. When the voltage on the charge node 24 is approximately $V_{REF}$, transistor 30 turns off. The charge thus stored on the capacitor is:

$$(V_{REF}-V_{SS})C_{22} \quad (3)$$

Assuming $V_{SS}$ to be ground, the charge expression reduces to:

$$V_{REF}C_{22} \quad (4)$$

When the clock signal goes to the high level, transistor 18 turns off and transistor 20 turns on, discharging the capacitor 22. For given clock frequency f, the charge transferred per second is:

$$fV_{REF}C_{22} \quad (5)$$

Thus, the current drawn from the second current node 34 $I_{34}$ is proportional to the reference voltage $V_{REF}$, clock frequency f, and capacitance $C_{22}$. Because reference voltages and clock frequencies are susceptible to being made to even less than 1% tolerances, the precision of the current source provided at current node 34 is primarily dependent upon the fabrication tolerance of the capacitor 22.

In a preferred form, the charge and discharge circuit 12 further includes a P channel transistor 36, an N channel transistor 38, and a capacitor 40 connected similar to transistors 18 and 20 and capacitor 22. An inverter 42 connected to the clock terminal 26 provides an inverted clock signal to the gates of transistors 36 and 38.

When the clock signal goes to a high level, enabling transistor 20 to discharge capacitor 22, inverter 42 enables transistor 36 to charge capacitor 40 from charge node 24 to $V_{REF}$. The charge then stored is:

$$V_{REF}C_{40} \quad (6)$$

When the clock signal goes low causing capacitor 22 to be charged via transistor 18, inverter 42 turns transistor 36 off and turns transistor 38 on, discharging capacitor 40. Thus, a charge of $V_{REF}C_{40}$ is transferred through transistor 36 every cycle of the clock. The consequent contribution to the charge per second drawn through transistor 30 from the output node 34 is:

$$fV_{REF}C_{40} \quad (7)$$

The total average current $I_{34}$ flowing through transistor 30 including the contribution of both capacitors 22 and 40 is $$I_{34}=fV_{REF}(C_{40}+C_{22}) \quad (8)$$

By matching capacitors 22 and 40, equation (8) simplifies to $$I_{34}=2fV_{REF}C_{22} \quad (9)$$

Since current flows during both the high level and the low level portions of the clock signal instead of just during the low portion, ripple at current node 34 is substantially reduced.

In the illustrated embodiment, ripple is further reduced while providing bias voltages, by the voltage bias generator and filter circuit 16 which comprises a first current mirror 44, a second current mirror 46, and a third current mirror 48.

The first current mirror 44 comprises a P channel transistor 50, a capacitor 52, and a P channel transistor 54. Transistor 50 has a gate and a drain connected to current node 34, and a source connected to a second supply voltage terminal $V_{DD}$. Capacitor 52 is connected between the gate of transistor 50 and $V_{DD}$. Transistor 54 has a gate connected to the gate of transistor 50, a source connected to $V_{DD}$, and a drain connected to the second current mirror 46. The capacitor 52 reduces ripple on the gates of transistors 50 and 54. Since transistors 50 and 54 have the same gate to source voltages, the precision current drawn through transistor 50 establishes a reference voltage on the gate of transistor 54 which causes transistor 54 to conduct the same amount of current as that drawn by transistors 50 so long as transistors 50 and 54 are matched. By constructing transistor 54 to have a smaller or larger channel width to channel length ratio than that of transistor 50, the current through transistor 54 will be made smaller or larger by the same proportion that the ratio of channel width to channel length is made smaller or larger.

The second current mirror 46 comprises an N channel transistor 56, a capacitor 58, and an N channel transistor 60. Transistor 56 has a drain and a gate connected to the drain of transistor 54, and a source connected to $V_{SS}$. Capacitor 58 is connected between the gate of transistor 56 and $V_{SS}$. Transistor 60 has a gate connected to the gate of transistor 56, a source connected to $V_{SS}$, and a drain connected to the third current mirror 48. The predetermined current provided by transistor 54 is forced through transistor 56 to establish an N channel bias voltage $V_{NBias}$ on the gate of transistor 56. Since transistors 56 and 60 have the same gate to source voltages, the current through transistor 60 is the same as or a predetermined proportion of that through transistor 56. The conditions for determining the proportion are the same as those described for transistors 50 and 54. $V_{NBias}$ is useful for biasing other N channel transistors to draw a current which is a predetermined proportion of the current through transistor 56. The capacitor 58 provides additional filtering to further reduce ripple.

The third current mirror 48 comprises a P channel transistor 62 and a P channel transistor 64. Transistor 62 has a gate and a drain connected to the drain of transistor 60, and a source connected to $V_{DD}$. Transistor 64 has a gate connected to the gate of transistor 62, a source connected to $V_{DD}$, and a drain connected to the first current node 32. The predetermined current provided by transistor 60 is forced through transistor 62 to establish a P channel bias voltage $V_{PBias}$ on the gate of transistor 62. Since transistors 62 and 64 have the same gate to source voltages, the current through transistor 64 is the same as or a predetermined proportion of that through transistor 62. The conditions for determining the proportion are the same as that described for transistors 50 and 54. The use of transistor 54 as a bias for the current control circuit 14 establishes the precision current source circuit 10 as self-biasing and makes it relatively immune to variations in power supply voltage.

A common problem in self-biasing reference circuits is ensuring that the circuit will begin functioning when power is applied. In the embodiment described above, only a nominal constraint on $V_{REF}$ assures start up. It will be clear that the circuit will begin functioning if transistor 30 can be made to turn on. However, before transistor 30 will turn on, its gate voltage must exceed its source voltage by the threshold voltage $V_{T30}$. Upon initiation of operation of the charge and discharge circuit 12, the source of transistor 30 will be driven to approximately $V_{SS}$. Thus, transistor 30 can be turned on if its gate voltage exceeds $V_{SS}$ by only $V_{T30}$. If the P tub of transistor 28 is connected to the source of transistor 28 so the P tub and source are at the same voltage, $V_{ref}$, then the P tub forms a PN junction with the drain which is of N type material. Consequently, the voltage on the drain can be no lower than one PN junction drop below $V_{ref}$. Since the gate of transistor 30 is connected to the gate of transistor 28, transistor 30 is ensured of being turned on, so long as $V_{ref}$ exceeds $V_{SS}$ by at least one PN junction voltage drop plus $V_{T30}$, starting the precision current source circuit 10 in operation.

While the invention has been described in the context of a preferred embodiment, it will be apparent to those skilled in the art that the present invention may be modified in numerous ways and may assume many embodiments other than that specifically set out and described above. Accordingly, it is intended by the appended claims to cover all modifications of the invention which fall within the true spirit and scope of the invention.

We claim:

1. A switched capacitor precision current source for providing a precision current via an output node, comprising:

capacitance means for storing charge;

current means for receiving a first reference voltage and for sourcing current from the output node to a charge node so long as the voltage on the charge node is less than a second reference voltage which is proportional to the first reference voltage;

charging means for charging the capacitance means from the charge node during a charge period; and discharging means for discharging the capacitance means during a discharge period.

2. The precision current source of claim 1 further comprising a bias means coupled to the output node for providing a voltage for biasing transistors to provide a current proportional to the precision current.

3. The precision current source of claim 1 or 2 wherein the current means further comprises:

a current source;

a first transistor having a source coupled to the first reference voltage, and a gate and a drain coupled to the current source; and a second transistor having a gate coupled to the gate of the first transistor, a source coupled to the charge node, and a drain providing the output node.

4. The precision current source of claim 3 wherein the charging means is a P channel transistor and the discharging means is an N channel transistor.

5. The precision current source of claim 1 further comprising:

second capacitance means for storing charge;

second charging means for charging the second capacitance means during the discharge period; and second discharging means for discharging the second capacitance means during the charge period.

6. The precision current source of claim 5 further comprising a bias means coupled to the output node for providing a voltage for biasing transistors to provide a current proportional to the precision current.

7. The precision current source of claim 5 or 6 wherein the current means further comprises:

a current source;

a first transistor having a source coupled to the first reference voltage, and a gate and a drain coupled to the current source; and a second transistor having a gate coupled to the gate of the first transistor, a source coupled to the charge node, and a drain providing the output node.

8. The precision current source of claim 7 wherein the first charging means is a first P channel transistor, the first discharging means is a first N channel transistor, the second charging means is a second P channel transistor, and the second discharging means is a second N channel transistor.

9. The precision current source of claim 8 wherein the bias means further comprises filter means for filtering ripple of the precision current.

10. A precision current source, comprising:

a current source;

a capacitor;

a first N channel transistor having a source for receiving a reference voltage, and a drain and a gate coupled to the current source;

a second N channel transistor having a gate coupled to the gate of the first N channel transistor, a drain providing an output, and a source;

a first P channel transistor having a gate for receiving a clock signal, a source coupled to the source of the second N channel transistor, and a drain coupled to a first terminal of the capacitor; and a third N channel transistor having a gate for receiving the clock signal, a drain coupled to the first terminal of the capacitor, and a source coupled to a second terminal of the capacitor.

11. The precision current source of claim 10 further comprising:

an inverter having an input for receiving the clock signal;

a second capacitor;

a second P channel transistor having a gate coupled to an output of the inverter, a source coupled to the source of the second N channel transistor, and a drain coupled to a first terminal of the second capacitor; and a fourth N channel transistor having a gate coupled to the output of the inverter, a drain coupled to the first terminal of the second capacitor, and a source coupled to a second terminal of the second capacitor.

* * * * *